United States Patent [19]

Young et al.

[11] Patent Number: 5,075,596

[45] Date of Patent: Dec. 24, 1991

[54] ELECTROLUMINESCENT DISPLAY BRIGHTNESS COMPENSATION

[75] Inventors: Edward L. Young, Sunnyvalle, Calif.; Thomas J. Rebeschi, North Haven, Conn.

[73] Assignee: United Technologies Corporation, Hartford, Conn.

[21] Appl. No.: 591,995

[22] Filed: Oct. 2, 1990

[51] Int. Cl.[5] ..... H01J 33/00

[52] U.S. Cl. ..... 315/169.3; 315/167; 340/781

[58] Field of Search ..... 315/169.3, 167; 340/713, 781

[56] References Cited

U.S. PATENT DOCUMENTS

| | | | |
|---|---|---|---|
| 3,813,575 | 5/1974 | Webb | 315/167 |
| 3,908,150 | 9/1975 | Webb | 315/169.3 |
| 4,642,524 | 2/1987 | Eaton et al. | 315/169.3 |
| 4,686,426 | 8/1987 | Fujioka et al. | 315/169.3 |
| 4,736,137 | 4/1988 | Ohwada et al. | 315/169.3 |
| 4,983,885 | 1/1991 | Fujioka et al. | 315/167 |

*Primary Examiner*—Eugene R. LaRoche
*Assistant Examiner*—Tan Dinh
*Attorney, Agent, or Firm*—Peter R. Ruzek

[57] ABSTRACT

The luminosity of electroluminescent display pixels arranged at intersection regions between row and column electrodes is controlled so as to compensate for the effect of interelectrode coupling by reducing the voltage differentials applied between the row electrode being addressed and the column electrodes relative to those coresponding to initial pixel luminosity data contained in an incoming data stream, as a direct function of total row luminosity information extracted from that segment of the incoming data stream which pertains to the respective row.

14 Claims, 5 Drawing Sheets

ELECTROLUMINESCENT DISPLAY BRIGHTNESS COMPENSATION

DESCRIPTION

1. Technical Field

This invention relates to a circuit for improving the readability and resolution of display panels, particularly electroluminescent display panels.

2. Background Art

Electroluminescent (EL) display arrangements are finding an ever increasing use for displaying information, especially output information from computers and computerized devices. One reason why such EL display arrangements are becoming more and more popular is because they are suitable for use in compact environments, such as in laptop computers and other portable electronic equipment requiring video image display. They can be packaged in relatively lightweight, thin housings and yet they provide resolution comparable to that of standard cathode ray tube displays. However, various problems are observable with the video quality of EL display arrangements.

One of these problems is that of "streaking", that is formation of streaks of luminosity exceeding that desired at picture elements (pixels) that are situated in the same row of the display as a pixel, or a plurality of pixels, of high desired luminosity. This phenomenon is of a particular significance when the EL display panel is constructed to have a "gray-scale" or shading capability and the driving circuitry that drives the panel or screen is constructed to apply any selected one of a progression of different voltage differentials to any particular one of the various pixels of the display screen. This is so because such streaking results in a diminished quality of the video image appearing on the respective electroluminescent display and thus impairs the legibility or perceptibility of the information that is to be conveyed by the displayed image, under certain operating conditions. Thus, for instance, in gray-scale EL displays, such as those having a 16 shade capability, streaking results because of partial cross-coupling of the pixel voltage differentials that are applied to certain pixels arranged in a given row to give them the desired intensities or luminescences to other pixels arranged in the same row. As will be discussed in more detail later, this coupling results from the combined effect of the column drive impedance which typically has a finite or significant value, and the row drive impedance which typically has a very low, almost non-existent, value in EL display arrangements of this type. To the EL display observer, the effect of this phenomenon is the appearance of a horizontal streak of brightness across the display screen in both directions commencing at the point where a bright video image occurs.

On the other hand, a completely different problem encountered in electroluminescent display technology, the so-called "inverse shadowing", has been identified in and addressed by a solution disclosed in U.S. Pat. No. 4,642,524 issued to Eaton et al. As explained in that patent, such inverse shadowing occurs in EL display arrangements when certain video patterns cause some display pixels that are "ON", to be of higher luminescence than other pixels in the same display that are also "ON". In this patent, the variation in pixel luminescence is attributed to variations in the rate of change of pixel voltage with respect to time (dv/dt). It is disclosed in this patent not only that the slope dv/dt decreases once a threshold voltage Vth needed to light any "ON" pixels is reached as compared to that encountered below the threshold voltage Vth, but also that the amount of such decrease is the greatest with all the pixels in a row "ON", while the slope dv/dt is larger than that with some pixels in a row "OFF" and the largest with all pixels in a row "OFF". This behavior is attributed in the above patent to progressive reduction in the capacitive loading in the particular row with decreasing number of the "ON" pixels. Inasmuch as the luminescence of the "ON" pixels of an EL display increases as the slope dv/dt of pixel voltage increases (at and above Vth), it is proposed in the aforementioned patent to establish a constant rate of change of voltage with respect to time at all "ON" pixels. The above patent discloses a circuit for maintaining a constant slope dv/dt at each pixel regardless of variations in load conditions, by applying a variable voltage or current source to the "ON" pixels in each row. The magnitude of the output of the voltage or current source is made directly dependent on the number of pixels in the respective row that are "ON" or, in other words, the voltage differentials applied across the various "ON" pixels of the particular row are increased with increasing number of the "ON" pixels in that row.

While the approach taken in the above patent may have certain validity and advantages in the EL display arrangement disclosed therein in that it presented a solution to the inverse shadowing problem by taking care of "ON" pixel brightness variation in non-gray-scale EL panels (while keeping the voltage differential applied to the "OFF" pixels below the threshold level), it would only exacerbate, rather than counteract, the streaking effect in gray-scale EL panels, inasmuch as it would further increase the already existing deviation of the "OFF" or "DIM" pixel brightness from the desired value thereof. While streaking has an effect on the displayed image that may appear to be similar to a certain degree to that of non-gray scale inverse shadowing in that they both reduce the legibility of alphanumerics and the contrast ratio and resolution of pictorial images, it has been established that, in terms of visual acuity, any step change in the brightness of an "OFF" or "DIM" pixel is much more intolerable than an equal step change in brightness of an already bright pixel.

Accordingly, it is a general object of the present invention to avoid the disadvantages of the prior art.

More particularly, it is an object of the present invention to provide an electroluminescent display arrangement which does not possess the disadvantages of the known arrangements of this kind.

Still another object of the present invention is so to develop the electroluminescent display arrangement of the type here under consideration as to improve the video quality of the images displayed on its electroluminescent display panel.

It is yet another object of the present invention to devise an arrangement of the above type, especially that having gray-scale capability, in which the visual effects of interpixel capacitive coupling are virtually eliminated.

A concomitant object of the present invention is to design the electroluminescent arrangement of the above type in such a manner as to be relatively simple in construction, inexpensive to manufacture, easy to use, and yet reliable in operation.

SUMMARY OF THE INVENTION

In keeping with these objects and others which will become apparent hereafter, one feature of the present invention resides in a method of controlling the luminosity of electroluminescent display pixels each of which is arranged at an intersection region between an individually addressable associated row electrode of a row electrode array and an individually addressable associated column electrode of a column electrode array, wherein the luminosity of any of the pixels of any row addressed at any given time is determined by a voltage differential established on the basis of desired pixel luminosity data for such pixel, which is contained in an incoming data stream segment pertaining to the pixels of such row, between a row voltage applied to the associated row electrode and a column voltage applied to the associated column electrode. The method of the present invention includes extracting total row luminosity information indicative of the total desired luminosity for all of the pixels of a respective pixel row to be addressed from the incoming data stream segment pertaining to such row, and generating a correction signal representative of such total row luminosity information. According to the invention, corrected voltage differentials to be applied to all of the pixels of the respective row are established, and all of the pixels of the respective row are subjected to the thus corrected voltage differentials that have been established for such row. The establishment of the corrected voltage differentials involves modifying at least one of the row voltage, and all of the column voltages for the pixels of the respective row, to the extent needed to compensate for interelectrode coupling, in proportion to the value of the correction signal and in a sense of reducing the voltage differentials established between the row and column electrodes associated with the pixels of that row relative to those corresponding to the pixel luminosity data contained in the incoming data stream segment pertaining to such row.

Thus, it may be seen that the present invention provides an adjustment to the effective pixel voltage of an electroluminescent display on a row by row basis in proportion to the average video intensity of each row of an electroluminescent display. Such adjustment of the effective pixel voltage on a row by row basis by adjusting either the row drive voltage or the column drive voltages, increases the contrast ratio of gray shades, thus improving the video quality of electroluminescent displays and the perceptibility of the images displayed on electroluminescent display panels.

BRIEF DESCRIPTION OF THE DRAWINGS

These and other objects features and advantages of the present invention will become more apparent in light of the detailed description of exemplary embodiments thereof as illustrated in the accompanying drawings, in which.

BEST MODE FOR CARRYING OUT THE INVENTION

Figure 1:
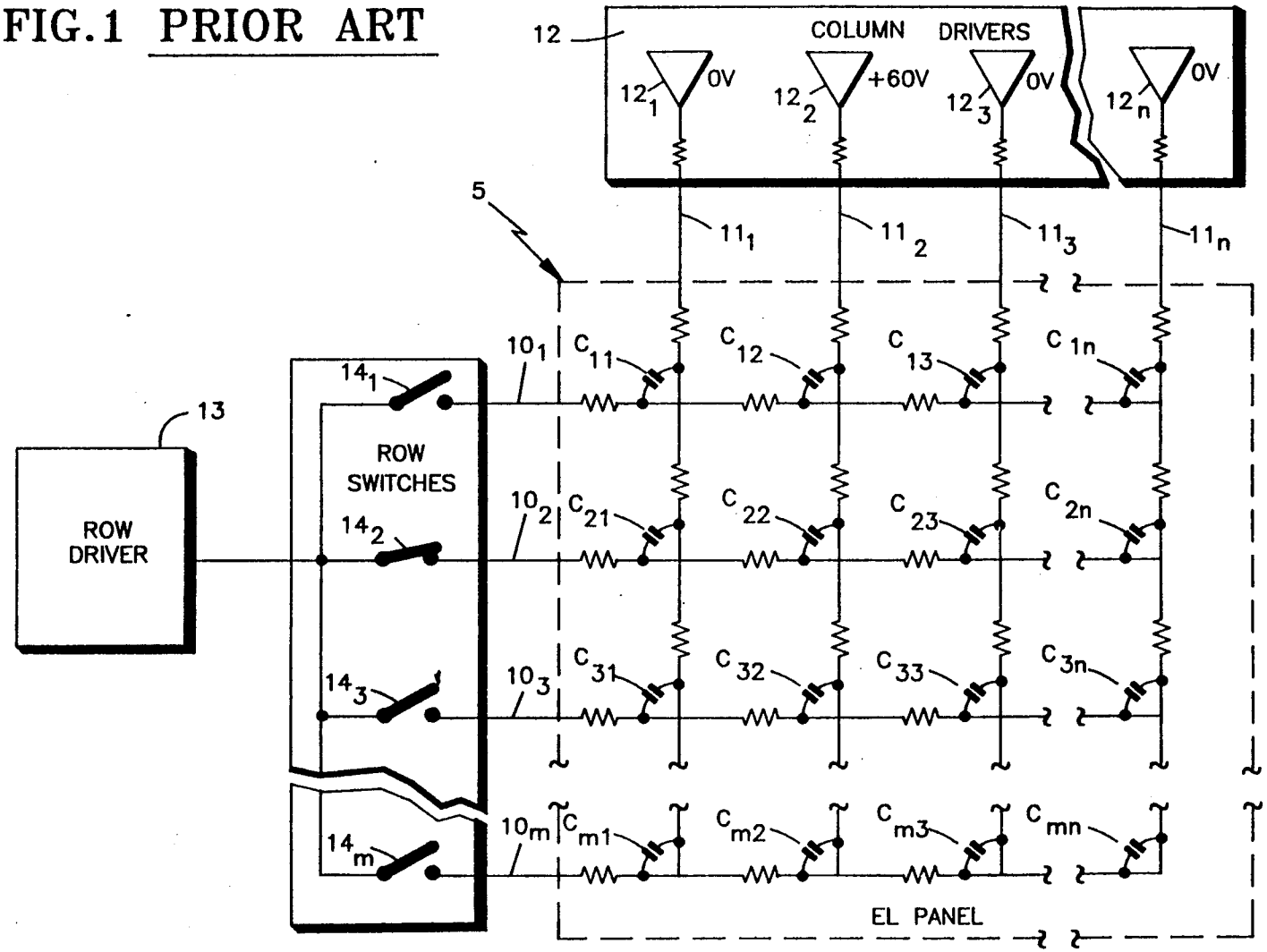
FIG. 1 PRIOR ART
FIG. 1 is a diagrammatic representation depicting an electrical model of a typical electroluminescent display panel and associated driver circuitry constructed in accordance with prior art for driving the display panel.

Referring now in more detail to the drawing, in which the same reference numerals and characters, possibly supplemented with subscripts and/or primes as appropriate, have been used throughout to denote corresponding parts, and first to FIG. 1 of the drawing, it may be seen therein that the reference numeral 5 has been used therein to identify an electroluminescent (EL) panel, of which merely an electrical model is presented throughout the drawings to form a basis for the following explanation of the aforementioned streaking phenomenon and the manner in which the present invention deals with this phenomenon.

The electroluminescent panel 5, as known in the art, includes horizontal electrodes $\mathbf{10}_1$ to $\mathbf{10}_m$ and vertical electrodes $\mathbf{11}_1$ to $\mathbf{11}_n$. Herein, as well as below, m and n represent integral numbers which may but need not be the same and are selected in accordance with the size, desired image resolution and other criteria pertaining to the panel 5 of the type in question, as is well known in this field. The horizontal electrodes $\mathbf{10}_1$ to $\mathbf{10}_m$ usually exhibit relatively low electric resistance, whereas the electric resistance of the vertical electrodes $\mathbf{11}_1$ to $\mathbf{11}_n$ is usually higher, sometimes much higher, than that of the horizontal electrodes $\mathbf{10}_1$ to $\mathbf{10}_m$, with the interelectrode capacitance being substantially evenly distributed along the lengths of each of the respective electrodes $\mathbf{10}_1$ to $\mathbf{10}_m$ and $\mathbf{11}_1$ to $\mathbf{11}_n$. Each of the vertical or column electrodes $\mathbf{11}_1$ to $\mathbf{11}_n$ has a relatively high resistance since they are generally made of a thin-film transparent material. For this reason, each of a plurality of column drivers $\mathbf{12}_1$ to $\mathbf{12}_n$ of a column driver device 12, which individually supply electric power to the respective column electrodes $\mathbf{11}_1$ to $\mathbf{11}_n$, "sees" a load equivalent to that of a delay line. On the other hand, since each of the horizontal or row electrodes $\mathbf{10}_1$ to $\mathbf{10}_m$, as mentioned before, has a relatively low resistance, a row driver 13 "sees", for all practical purposes, a purely capacitive load when any one of a set of row switches $\mathbf{14}_1$ to $\mathbf{14}_m$ is closed to supply electric power from the row driver 13 to the respectively associated one of the row electrodes $\mathbf{10}_1$ to $\mathbf{10}_m$. In the aforementioned electrical model of the EL display panel 5, the interelectrode capacitances are depicted as capacitor $C_{11}$ to $C_{mn}$ situated between the row electrodes $\mathbf{10}_1$ to $\mathbf{10}_m$ and the column electrodes $\mathbf{11}_1$ to $\mathbf{11}_n$ at the respective intersections thereof. It will be appreciated that in the physical embodiment of the electroluminescent panel 5 the row electrodes $\mathbf{10}_1$ to $\mathbf{10}_m$ and the column electrodes $\mathbf{11}_1$ to $\mathbf{11}_n$ do not actually intersect but rather bypass each other by being located in different planes at such intersections. Nevertheless, the regions at which the respective row electrodes $10_1$ to $10_m$ bypass the respective column electrodes $11_1$ to $11_n$, which also constitute the locations of the respective pixels, will be referred to herein as the intersection regions.

Figure 2:
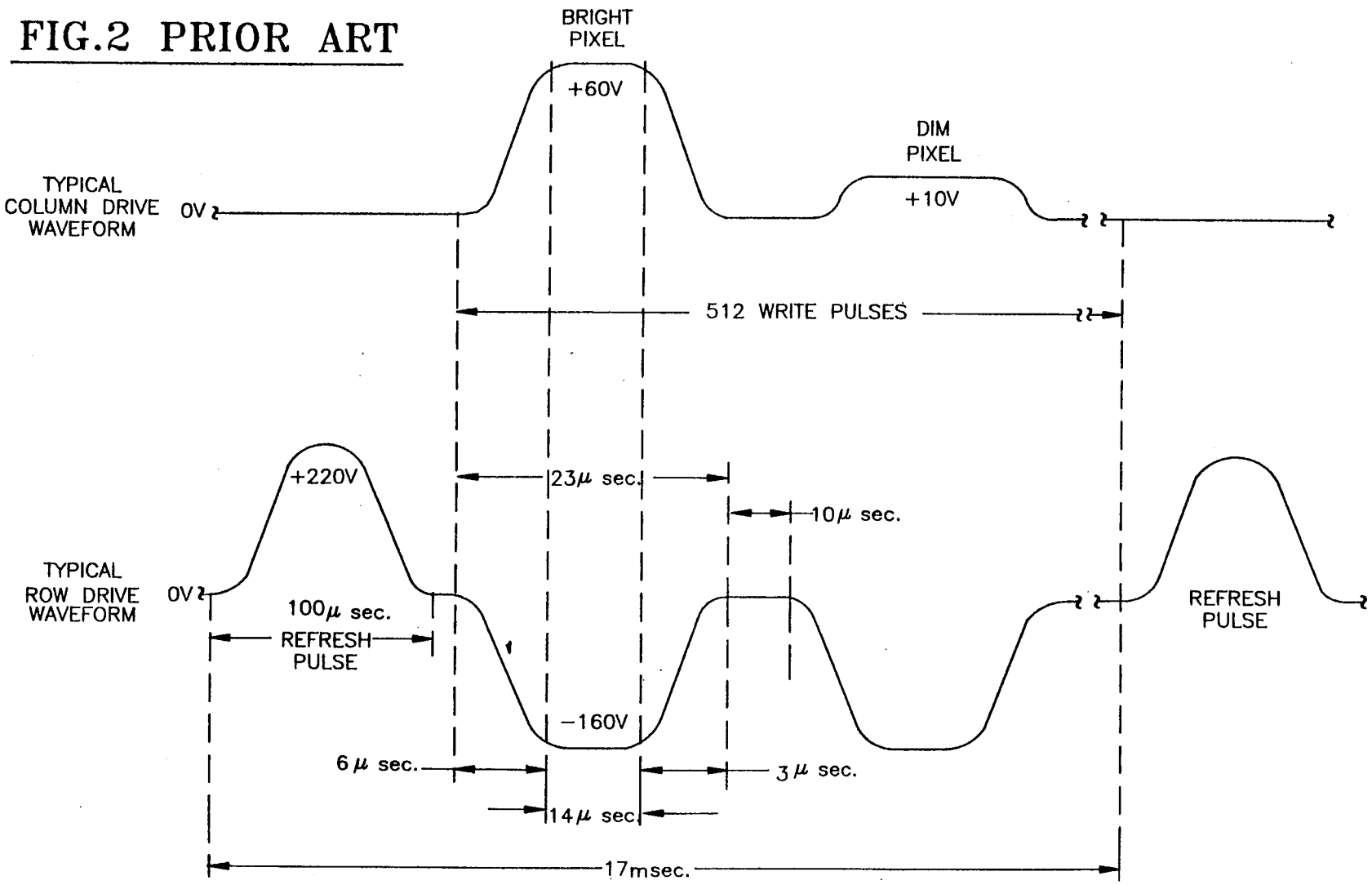
FIG.2 PRIOR ART
FIG. 2 is a graphic representation of typical row and column drive waveforms that may be used in accordance with the prior art to drive the display panel of FIG. 1.

Both the row driver 13, on the one hand, and the column drivers $12_1$ to $12_n$, on the other hand, are operated in two different modes, namely a write mode and a refresh mode, of which exemplary electrical waveform representations are presented in FIG. 2 of the drawing. In the write mode, each of the row electrodes $10_1$ to $10_m$ is pulsed sequentially down to −160 volts (typically) by closing that of the row switches $14_1$ to $14_m$ (such as the switch $14_2$ as seen in FIG. 1) that is associated with the respective row that is then being addressed, while the voltages supplied by the column drivers $12_1$ to $12_n$ individually determine the pixel intensities along the row being addressed at that time by creating respective voltage differentials with respect to the voltage supplied to that of the row electrodes $10_1$ to $10_m$ that is then being addressed. Those of the row electrodes $10_1$ to $10_m$ that are not being addressed at any particular time are left floating to reduce the capacitive load as seen by the column drivers $12_1$ to $12_n$.

In the refresh mode, all of the row switches $14_1$ to $14_m$ are closed and all of the row electrodes $10_1$ to $10_m$ are simultaneously pulsed up (typically to +220 volts) while the column electrodes $11_1$ to $11_n$ are all maintained at zero volts.

During the operation of the display panel 5, there is encountered cross coupling of pixel intensities to other pixels along the same row. This cross coupling is attributable to the significant or finite impedances of both the column driver outputs and the column electrodes $11_1$ to $11_n$ themselves. The output stage of each column driver $12_1$ to $12_n$ typically consists of a push-pull complementary FET stage that exhibits considerable crossover distortion. As the respective one of the column drivers $12_1$ to $12_n$ switches between sourcing and sinking current, it can have significant output impedance. Furthermore, as mentioned before, the column electrodes $11_1$ to $11_n$ themselves are made of thin film material which has a significant finite impedance.

To illustrate the electrical conditions encountered when this known EL display arrangement as described so far is being operated in the situation illustrated in FIG. 1 of the drawing, that is, with the switch $14_2$ that is connected to the row electrode $10_2$ being closed and while operating in the write mode, let us assume that the column driver $12_2$ (for instance) that is connected to the column electrode $11_2$ is pulsed to +60 volts representing full pixel brightness, while the remaining ones of the column electrodes $11_1$ to $11_n$ are maintained at ground potential, representing no pixel brightness (i.e. "OFF" pixels). Since all of the row electrodes $10_1$ to $10_m$ except for the row electrode $10_2$ are floating, because the associated ones of the row switches $14_1$ to $14_m$ are open, the interelectrode capacitance $C_{12}$ to $C_{m2}$ between the column electrode $11_2$ and the floating ones of the row electrodes $10_1$ to $10_m$ couple some of this column pulse waveform onto the aforementioned floating ones of the row electrodes $10_1$ to $10_m$, which then couple this waveform at least through the interelectrode capacitances $C_{11}$, $C_{13}$, $C_{31}$, and $C_{33}$ at least to the column electrodes $11_1$ and $11_3$. Since the latter are driven through a finite driver impedance, the bright pixel occurring at the intersection region of the row electrode $10_2$ with the column electrode $11_2$ thus causes partial intensities to appear at all pixels along the row electrode $10_2$ which is being addressed.

Before turning to the remaining Figures of the drawing that depict several constructions of the EL display arrangement embodying the present invention that are somewhat modified relative to one another so as to take into account several aspects of this invention, it is to be mentioned that this invention is based on the recognition of the fact that a bright image in a particular row couples uniformly to each pixel in that row and that the amount of coupling to each pixel is proportional to the average video intensity along each row, as gleaned from an observation of cross coupled pixel intensities.

Figure 3:
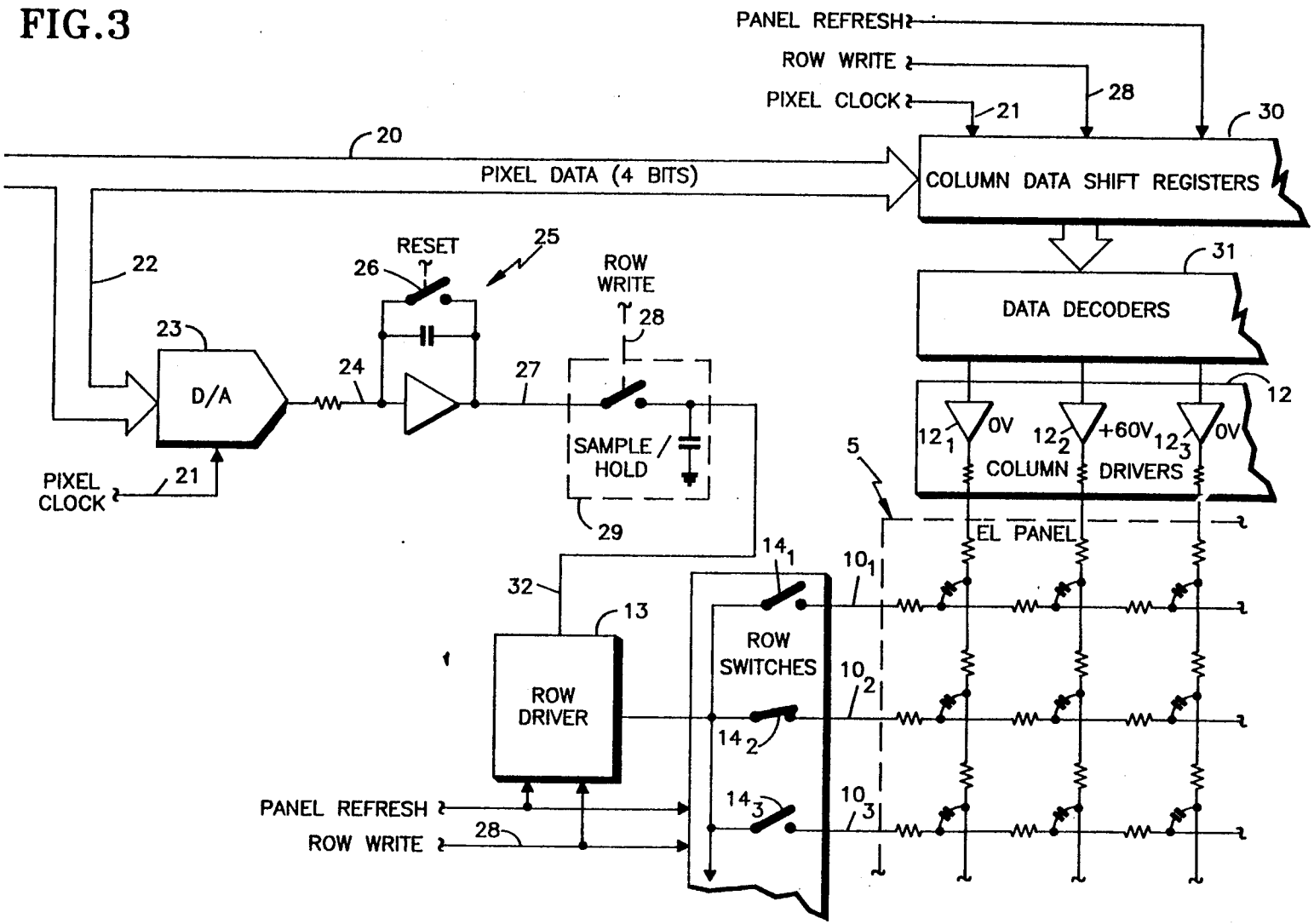
FIG. 3 is a view similar to that of FIG. 1 but wherein the driver circuitry for driving the electroluminescent display panel is constructed in accordance with the present invention to use digitally encoded pixel intensity information of the type depicted in FIG. 2 for row by row brightness compensation in the manner proposed by the present invention.

FIG. 3 of the drawing shows one way in which this realization is used to advantage in accordance with the present invention to improve the quality of the image displayed by the EL display panel 5 that is capable of displaying varying shades of a color (which need not necessarily be gray but nevertheless is referred to throughout the text as gray for the sake of convenience). As shown in this Figure, a driver circuit of an EL display arrangement is supplied with digitally encoded pixel intensity information and converts this information into row and column voltages or electrical potentials that drive the EL display panel 5 of the type of which the electrical model was heretofore described and only a pertinent portion of which is shown in FIG. 3. A video input signal carrying the information to be displayed on the screen or panel 5 comprises a digitally encoded, serial 4-bit pixel intensity data stream 20 which includes consecutive data segments each of which contains information describing the intensities desired for the pixels of a particular row. Each of these data segments is loaded, at the appropriate time, into column data shift registers of a storage device 30 that is associated with the column drive device 12, providing a column driver signal synchronous with a pixel clock signal 21. For illustration purposes, reference will be made hereinafter, as it was before, to the pixel intensity data stream segment for the pixels served by the row electrode $10_2$; however, it will be appreciated that the operation as described in this context is equally applicable to the pixel intensity data stream segments associated with all remaining ones of the row electrodes $10_1$ to $10_m$.

The pixel intensity data stream 20 is further and simultaneously supplied, as indicated at 22, as an integrator circuit input signal to a digital to analog converter 23 that converts this digital signal into an analog signal having the same information contents. This analog signal is then fed through a connecting line 24 into an integrator that is collectively identified by the reference numeral 25. The integrator 25 is reset to zero prior to or at the beginning of the row electrode data stream segment for the row electrode $10_2$, by momentarily closing at such a time a switch 26 that is connected in parallel with the integrator 25. After the switch 26 is opened again at the beginning of the next incoming data segment, the integrator 25 integrates the incoming data. As a consequence, at the end of the segment of the data stream 20 pertaining to the pixels arranged along the row electrode $10_2$, not only are all of the column data shift registers of the storage device 30 filled with pixel data pertaining to the respective pixels of the pixel row to be written next, but also an integrator output 27 carries a correction voltage that is proportional to the average pixel intensity for the pixels served by the row electrode $10_2$ of the panel 5. If none of the pixels supplied with electric power by the row electrode $10_2$ is to be lit, the integrator 25 produces a correction voltage of zero volts. If all or almost all of such pixels are to be lit, then the maximum contemplated correction voltage is produced by the integrator 25. Between these extremes, the correction voltage is linearly proportional to the number of pixels to be lit.

Pixel intensity data stored in the column data shift registers of the storage device 30 is decoded and converted to appropriate column driver voltages, separately for each of the column electrodes $11_1$ to $11_n$, by associated data decoders of a data decoder device 31, in a manner known in the art. A row write signal 28 strobes decoded data from the data decoders of the data decoder device 31 to the respective column drivers $12_1$ to $12_n$ of the column drive device 12 and also activates a sample and hold circuit 29 which then presents the correction voltage appearing at the integrator output 27 through a feeding line 32 to the row driver 13 and holds the correction voltage at a constant level while the respective row is being written. As the row switch $14_2$ connects the row driver 13 to the row electrode 24, the row driver 28 produces a row driver signal in the form of a nominal write pulse of −160 V (the same as depicted in FIG. 2), but with additional voltage of up to +10 V being added thereto as a result of the feeding of the correction voltage signal through the feeding line 32 to the row driver 13, to compensate for the interelectrode coupling that has been described heretofore, such that the voltage supplied by the row driver 13 through the respective switch $14_2$ to the respective row electrode $10_2$ that is then being addressed can have a value anywhere between −160 V and −150 V, depending on the value of the correction voltage signal appearing on the line 32. Thus, it may be seen that the voltage or potential differentials applied across all of the pixels arranged in the row served by the row electrode $10_2$ are reduced (because of the reduction in the absolute value of the voltage supplied to the row electrode $10_2$) in direct proportion to, that is as a direct function of, the average brightness originally intended for the pixels of that row, with the result that, between the effect of the (reduced) voltage differentials and that of the interelectrode coupling, the brightnesses of all of the pixels in the respective row then being addressed are substantially at their originally desired levels.

As the row associated with the row electrode $10_2$ is being written, the pixel intensity data stream segment for the pixel row associated with the row electrode $10_3$ begins loading into the column shift registers of the storage device 30 and the integrator 25 is reset to begin processing the pixel intensity data for the pixel row addressed by the row electrode $10_3$, so that the value of the correction voltage appearing at the output of the integrator 25 just prior to the closing of the switch $14_3$ associated with the row electrode $10_3$ (and of the switch of the sample and hold circuit 29) corresponds to or is representative of the average pixel intensity for the row $10_3$. This means that, by the time the switch of the sample and hold circuit 29 is temporarily closed (as shown, by the row write signal 28, i.e. simultaneously with the closing of the switch $14_3$), the value of the correction signal supplied to the row driver 13 through the line 32 is that appropriate for correcting the voltage supplied through the switch $14_3$ to the row $10_3$.

Figure 4:
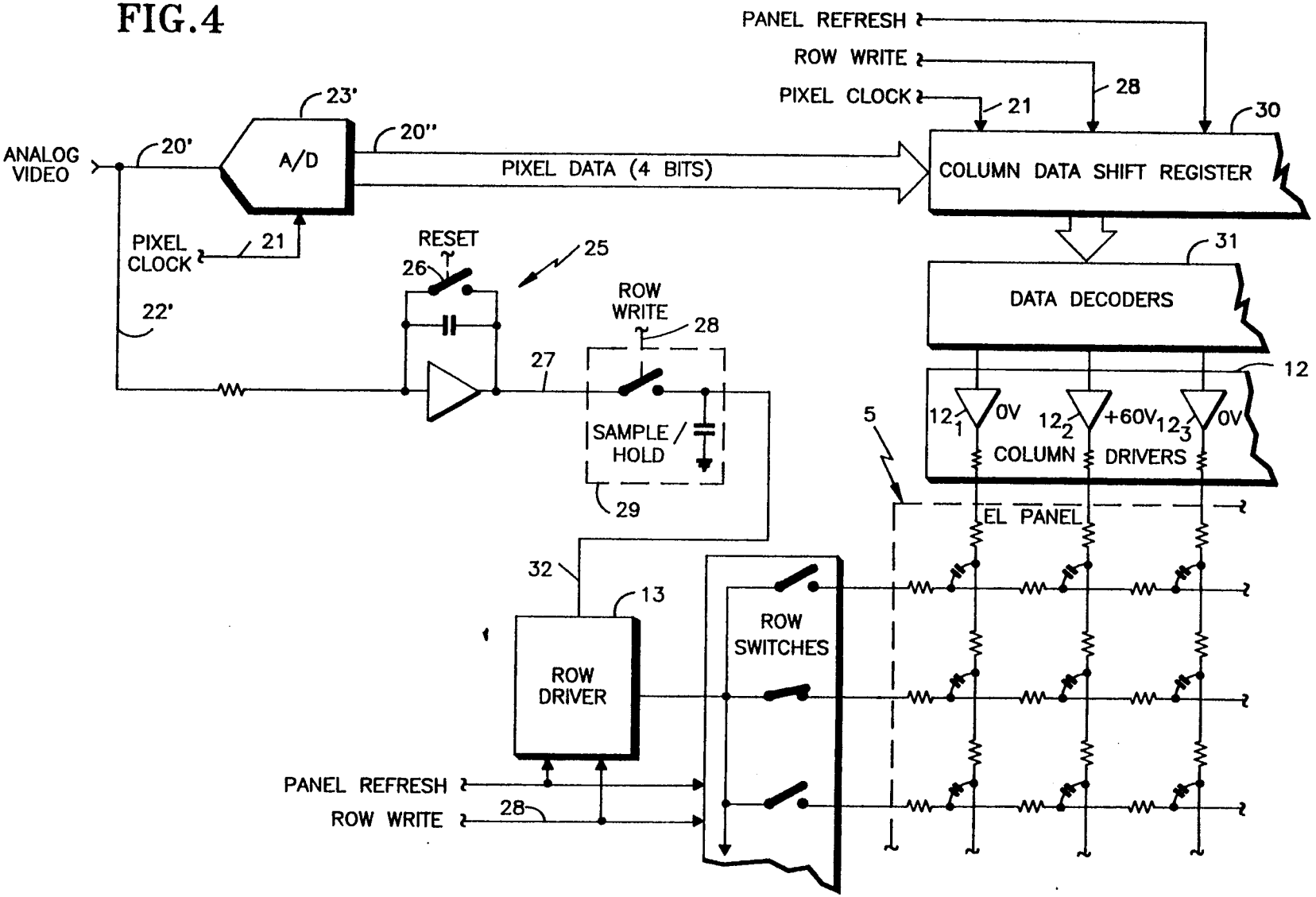
FIG. 4 is a view similar to that of FIG. 3 but wherein the driver circuitry for driving the electroluminescent display panel is constructed to use analog signal pixel intensity information for the row by row brightness compensation according to the invention.

Referring now to FIG. 4, it may be seen that it depicts the situation where the incoming video input signal containing pixel intensity information is available as an analog signal, rather than the digitally encoded bit stream of FIG. 3. Under these circumstances, there is no need for the digital to analog converter 23 arranged upstream of the integrator 25 in the arrangement of FIG. 3, and hence this converter 23 is omitted in the arrangement of FIG. 4. Thus, in the latter arrangement, an analog video input signal appearing on an input line 20′ constitutes an integrator circuit input signal which is fed through a connecting line 22′ directly to the input of the integrator 25. However, an input of an analog to digital converter 23′ is connected to the line 20′, and the converter 23′ converts the incoming analog video input signal into a digital column driver signal 22″ that is then loaded into the column data shift registers of the storage device 30 synchronously with the pixel clock signal 21. Except for the substitution of the A/D converter 23′ for the D/A converter 23, the circuits of FIGS. 3 and 4 are identical and they function in the same manner as discussed heretofore relative to FIG. 3. The integrator 25 again produces the correction voltage appearing at its output line 27, this correction voltage being proportional to the average pixel intensity for the pixels served by the then selected row electrode $10_2$ and being fed to the row driver 13 by the sample and hold circuit 29 and the line 32 and vectorially added to the row driver signal (i.e. subtracted therefrom in the absolute value terms) to compensate for interelectrode capacitive coupling.

Figure 5:
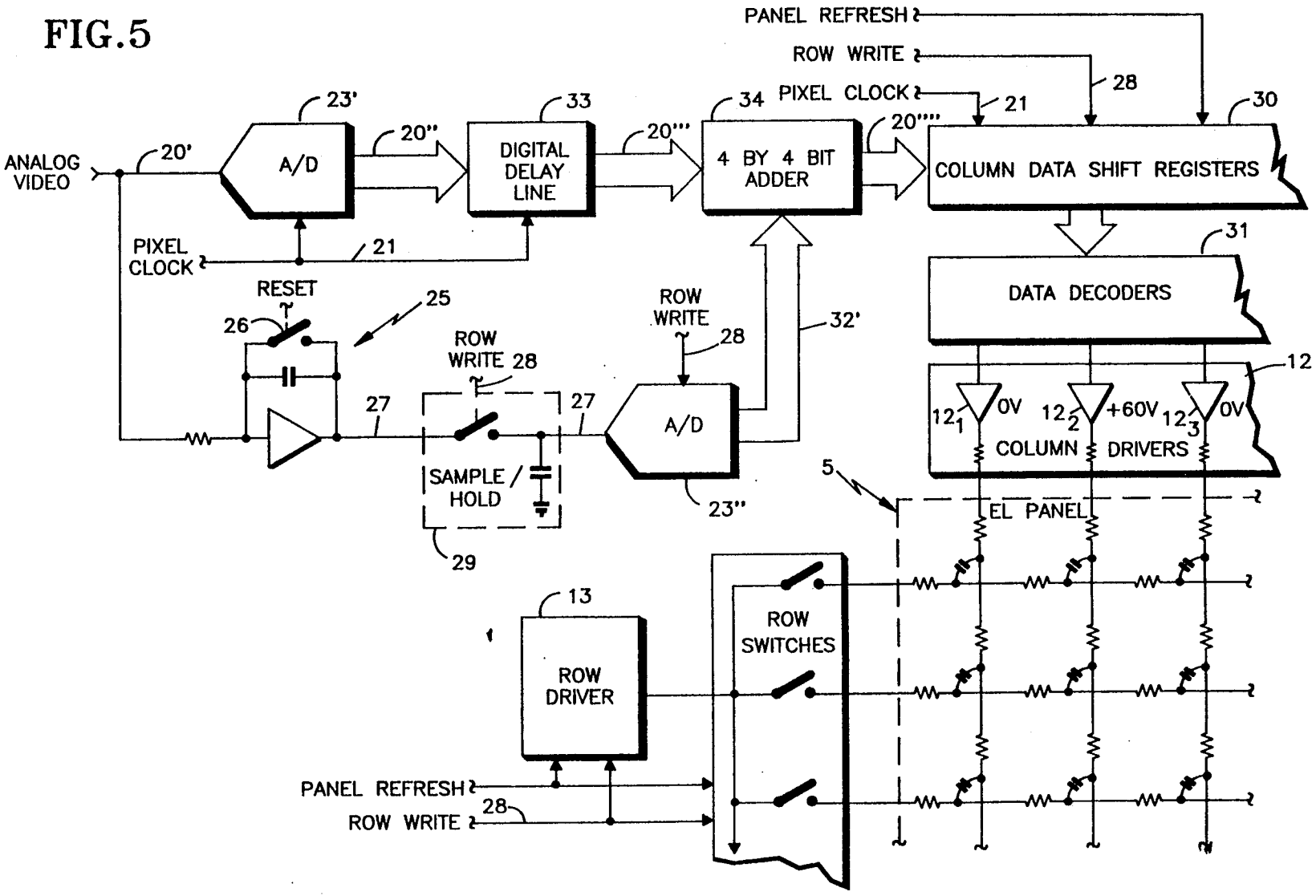
FIG. 5 is another view similar to that of FIG. 3 but showing an electroluminescent display panel driver circuitry constructed to use analog signal pixel intensity information to achieve row by row brightness compensation according to the invention by digitally combining compensation information to column drive data.

Alternate approaches to implementing row by row brightness compensation are also contemplated and fall under the purview of the present invention. One of such approaches is depicted in FIG. 5 of the drawing and provides row by row brightness compensation to the electroluminescent panel 5 by digitally subtracting digitally encoded compensation information from the original digitally encoded pixel intensity information. In this arrangement, like in that of FIG. 4, the analog video input signal is again fed through the line 20′ into the A/D converter 23′, and once more directly into the integrator 25. Synchronously with the pixel clock signal 21, the converted digital column driver signal appearing at an output 20″ of the converter 23′ is delayed by a digital delay line or a similar delay device 33 for a period of time corresponding to that of writing one row, resulting in a delayed converted column driver signal at an output 20‴ of the delay device 33, to maintain proper synchronization considering the fact that the correction voltage signal appearing on the line 27 for a particular row is not available until the end of the data stream segment relating to that row. When the row write signal 28 strobes the decoded data to the column drivers $12_1$ to $12_n$ of the column driver device 12, it also activates the sample and hold circuit 29 to feed the correction voltage appearing at the connection line 27. However, in this case, the correction voltage is supplied to a second analog to digital converter 23″, instead of being supplied to the row driver 13 as it was in the arrangements of FIGS. 3 and 4. The row write signal 28 enables the second analog to digital converter 23″ at this time so that, while decoded data is being strobed by the row write signal 28 to the column drivers $12_1$ to $12_n$, the next succeeding pixel intensity data stream is being processed in the converter 23′ due to the aforementioned delay. A digital correction signal issued by the second converter 23″ and appearing at an output 32′ thereof is then subtracted by a digital adder 34 from the delayed, digitally converted column driver signal that is supplied to an input of the adder 34 by the output 20''' of the delay device 33. The corrected digital signal resulting from such subtraction of the digital correction signal from the delayed converted digital column driver signal is then fed through a connecting line or bus into the column data shift registers of the storage device 30 synchronously with the pixel clock 21 at the occurrence of the next row write signal 28. In this arrangement, brightness compensation for interelectrode capacitive coupling is effected by modifying the column driver voltages, again in such a sense as to reduce the voltage or potential differentials effective at all of the pixels of the respective row. In this case, however, this voltage differential reduction is achieved not by reducing the absolute value of the voltage supplied to the respective row electrode, such as $\mathbf{10}_2$, as it was in the previously discussed constructions, but rather by individually reducing by the appropriate amount the absolute values of the voltages supplied to the column electrodes $\mathbf{11}_1$ to $\mathbf{11}_n$.

While embodiments of arrangements for modifying the row or column drive voltages to provide for brightness compensation are disclosed herein using D/A and A/D converters, an integrator and a sample and hold circuitry, alternate approaches using different functional elements are conceivable and contemplated by the present invention. So, for instance, both the row drive voltages and the column drive voltages could be modified by appropriate amounts such that the end effect would be the desired reduction of the voltage differentials effective at all the pixels of the respective row then being addressed. The functions performed might be implemented in silicon and embodied in row driver and/or column driver integrated circuits. Furthermore, the integration and delay functions could be embodied in software and executed using a microprocessor and related circuitry.

Although the invention has been shown and described with respect to illustrative embodiments thereof, it should be understood by those skilled in the art that the foregoing and various other changes, omissions and additions in the form and detail thereof may be made therein without departing from the spirit and scope of the invention.

We claim:

1. A method of controlling the luminosity of electroluminescent display pixels each arranged at an intersection region between an individually addressable associated row electrode of a row electrode array and an individually addressable associated column electrode of a column electrode array, the luminosity of any of the pixels of any row addressed at any given time being determined by a voltage differential established on the basis of desired pixel luminosity data for such pixel, which is contained in an incoming data stream segment pertaining to the pixels of such row, between a row voltage applied to the associated row electrode and a column voltage applied to the associated column electrode, comprising the steps of extracting total row luminosity information indicative of the total desired luminosity for all of the pixels of a respective pixel row to be addressed from the incoming data stream segment pertaining to such row, and generating a correction signal representative of such total row luminosity information;

establishing corrected voltage differentials to be applied to all of the pixels of the respective row, including providing for each respective row an initial row voltage and for each respective one of the columns an initial column voltage pertaining to the pixel of the respective row, and modifying at least one of the initial row voltage, and all of the initial column voltages for the pixels of the respective row, to the extent needed to compensate for interelectrode coupling, in proportion to the value of the correction signal and in a sense of reducing the voltage differentials established between the row and column electrodes associated with the pixels of that row relative to those corresponding to the pixel luminosity data contained in the incoming data stream segment pertaining to such row; and subjecting all of the pixels of the respective row to the thus corrected voltage differentials that have been established for such row.

2. The method as defined in claim 1, wherein said establishing step includes individually reducing the absolute value of the initial row voltage for each of the rows correspondingly to the correction signal applicable to that row to form a modified row voltage for application to the respective row electrode during said subjecting step.

3. The method as defined in claim 2 for use in a situation where the incoming data stream segment consists of digital data, wherein said extracting step includes converting the digital data of the segment into corresponding analog data, and integrating such analog data to present the correction signal as a correction voltage.

4. The method as defined in claim 2 for use in a situation where the incoming data stream segment consists of analog data, wherein said extracting step includes integrating such analog data to present the correction signal as a correction voltage.

5. The method as defined in claim 4, wherein said establishing step further includes converting the analog data of the segment into corresponding initial digital data for use in establishing the individual initial column voltages to be applied to the respective column electrodes during said subjecting step.

6. The method as defined in claim 1, wherein said establishing step includes reducing the absolute value of each of the initial column voltages in correspondence with the correction signal applicable to that row to form a modified column voltage for application to the respective column electrode during said subjecting step.

7. A method of controlling the luminosity of electroluminescent display pixels each arranged at an intersection region between an individually addressable associated row electrode of a row electrode array and an individually addressable associated column electrode of a column electrode array, the luminosity of any of the pixels of any row addressed at any given time being determined by a voltage differential established on the basis of desired pixel luminosity data for such pixel, which is contained in an incoming data stream segment consisting of analog data pertaining to the pixels of such row, between a row voltage applied to the associated row electrode and a column voltage applied to the associated column electrode, comprising the steps of extracting total row luminosity information indicative of the total desired luminosity for all of the pixels of a respective pixel row to be addressed from the incoming data stream segment pertaining to such row and generating a correction signal representative of such total row luminosity information, including integrating said analog data to present a correction voltage, and converting such correction voltage into a corresponding digital correction signal;

establishing corrected voltage differentials to be applied to all of the pixels of the respective row, including modifying all of the column voltages for the pixels of the respective row to the extent needed to compensate for interelectrode coupling, in proportion to the value of the digital correction signal and in a sense of reducing the voltage differentials established between the row and column electrodes associated with the pixels of that row relative to those corresponding to the pixel luminosity data contained in the incoming data stream segment pertaining to such row, including converting the analog data of the segment into corresponding initial digital signals each individually applicable to a different one of the columns, providing the same row voltage for all of the rows, and a plurality of individual initial column voltages each in association with the respective row for a different one of the columns, and reducing the absolute value of each of the initial column voltages in correspondence with the digital correction signal applicable to that row to form a modified column voltage for the respective column electrode, including digitally subtracting the digital correction signal from each of the initial digital signals to form a modified digital signal for each of the columns, and using the thus modified digital signals for forming the modified column voltages; and subjecting all of the pixels of the respective row to the thus corrected voltage differentials that have been established for such row.

8. An arrangement for controlling the luminosity of electroluminescent display pixels each arranged at an intersection region between an individually addressable associated row electrode of a row electrode array and an individually addressable associated column electrode of a column electrode array, the luminosity of any of the pixels of any row addressed at any given time being determined by a voltage differential established on the basis of desired pixel luminosity data for such pixel, which is contained in an incoming data stream segment pertaining to the pixels of such row, between a row voltage applied to the associated row electrode and a column voltage applied to the associated column electrode, comprising means for extracting total row luminosity information indicative of the total desired luminosity for all of the pixels of a respective pixel row to be addressed from the incoming data stream segment pertaining to such row, and for generating a correction signal representative of such total row luminosity information;

means for establishing corrected voltage differentials to be applied to all of the pixels of the respective row, including means for providing for each respective row an initial row voltage and for each respective one of the columns an initial column voltage pertaining to the pixel of the respective row, and means for modifying at least one of the initial row voltage, and all of the initial column voltages for the pixels of the respective row, to the extent needed to compensate for interelectrode coupling, in proportion to the value of said correction signal and in a sense of reducing the voltage differentials established between the row and column electrodes associated with the pixels of that row relative to those corresponding to the pixel luminosity data contained in the incoming data stream segment pertaining to such row; and means for subjecting all of the pixels of the respective row to the thus corrected voltage differentials that have been established for such row.

9. The arrangement as defined in claim 8, wherein said establishing means includes means for individually reducing the absolute value of the initial row voltage for each of the rows correspondingly to the correction signal applicable to that row to form a modified row voltage for application by said subjecting means to the respective row electrode.

10. The arrangement as defined in claim 9 for use in a situation where the incoming data stream segment consists of digital data, wherein said extracting means includes means for converting the digital data of the segment into corresponding analog data, and means for integrating such analog data to present the correction signal as a correction voltage.

11. The arrangement as defined in claim 9 for use in a situation where the incoming data stream segment consists of analog data, wherein said extracting means includes means for integrating such analog data to present the correction signal as a correction voltage.

12. The arrangement as defined in claim 11, wherein said establishing means further includes means for converting the analog data of the segment into corresponding initial digital data for use in establishing the individual initial column voltages to be applied by said subjecting means to the respective column electrodes.

13. The arrangement as defined in claim 8, wherein said establishing means includes means for reducing the absolute value of each of the initial column voltages in correspondence with the correction signal applicable to that row to form a modified column voltage for application by said subjecting means to the respective column electrode.

14. An arrangement for controlling the luminosity of electroluminescent display pixels each arranged at an intersection region between an individually addressable associated row electrode of a row electrode array and an individually addressable associated column electrode of a column electrode array, the luminosity of any of the pixels of any row addressed at any given time being determined by a voltage differential established on the basis of desired pixel luminosity data for such pixel, which is contained in an incoming data stream segment consisting of analog data pertaining to the pixels of such row, between a row voltage applied to the associated row electrode and a column voltage applied to the associated column electrode, comprising means for extracting total row luminosity information indicative of the total desired luminosity for all of the pixels of a respective pixel row to be addressed from the incoming data stream segment pertaining to such row and generating a correction signal representative of such total row luminosity information, including means for integrating said analog data to present a correction voltage, and means for converting such correction voltage into a corresponding digital correction signal;

means for establishing corrected voltage differentials to be applied to all of the pixels of the respective row, including means for modifying all of the column voltages for the pixels of the respective row to the extent needed to compensate for interelectrode coupling, in proportion to the value of the digital correction signal and in a sense of reducing the voltage differentials established between the row and column electrodes associated with the pixels of that row relative to those corresponding to the pixel luminosity data contained in the incoming data stream segment pertaining to such row, including means for converting the analog data of the segment into corresponding initial digital signals each individually applicable to a different one of the columns, means for providing the same row voltage for all of the rows, and a plurality of individual initial column voltages each in association with the respective row for a different one of the columns, and means for reducing the absolute value of each of the initial column voltages in correspondence with the digital correction signal applicable to that row to form a modified column voltage for the respective column electrode, including means for digitally subtracting the digital correction signal from each of the initial digital signals to form a modified digital signal for each of the columns for use of the thus modified digital signals in forming the modified column voltages; and means for subjecting all of the pixels of the respective row to the thus corrected voltage differentials that have been established for such row.

* * * * *